US009056218B2

(12) United States Patent
Zoltak

(10) Patent No.: US 9,056,218 B2
(45) Date of Patent: Jun. 16, 2015

(54) RESISTANCE TRAINING DEVICE AND METHOD OF USE

(75) Inventor: Matthew Seyler Zoltak, Philadelphia, PA (US)

(73) Assignee: ProCore Sports, LLC, Sarasota, FL (US)

( * ) Notice: Subject to any disclaimer, the term of this patent is extended or adjusted under 35 U.S.C. 154(b) by 308 days.

(21) Appl. No.: 13/404,947

(22) Filed: Feb. 24, 2012

(65) Prior Publication Data

US 2012/0220436 A1 Aug. 30, 2012

Related U.S. Application Data

(60) Provisional application No. 61/446,855, filed on Feb. 25, 2011.

(51) Int. Cl.

| | |
|---|---|
| ***A63B 21/04*** | (2006.01) |
| ***A63B 21/02*** | (2006.01) |
| ***A63B 21/055*** | (2006.01) |
| ***A63B 21/00*** | (2006.01) |
| ***A63B 23/035*** | (2006.01) |
| ***A63B 23/04*** | (2006.01) |
| ***A63B 23/12*** | (2006.01) |
| *A63B 69/00* | (2006.01) |
| *A63B 69/14* | (2006.01) |
| *A63B 5/22* | (2006.01) |
| *A63B 23/02* | (2006.01) |

(52) U.S. Cl.

CPC ..... *A63B 21/0552* (2013.01); *A63B 69/002* (2013.01); *A63B 69/004* (2013.01); *A63B 69/14* (2013.01); *A63B 5/22* (2013.01); *A63B 21/1426* (2013.01); *A63B 21/1484* (2013.01); *A63B 23/0205* (2013.01); *A63B 23/03508* (2013.01); *A63B 23/0355* (2013.01); *A63B 23/0405* (2013.01); *A63B 23/047* (2013.01); *A63B 23/1209* (2013.01); *A63B 2069/0006* (2013.01); *A63B 2209/10* (2013.01)

(58) Field of Classification Search

CPC ..... A63B 21/0052; A63B 21/1426; A63B 21/143; A63B 23/03508; A63B 23/0355; A63B 23/0405; A63B 23/047; A63B 23/1209; A63B 69/002; A63B 69/14; A63B 2069/0006

USPC ..... 482/79, 105, 116, 121–124, 129, 139, 482/148, 20–22; 473/422, 450, 451, 464, 473/615; 434/392

See application file for complete search history.

(56) References Cited

U.S. PATENT DOCUMENTS 3,256,015 A * 6/1966 Perrin ..... 482/129
3,752,474 A * 8/1973 Macabet et al. ..... 482/131

(Continued)

OTHER PUBLICATIONS

"Arm" definition, <http://www.memidex.com/arm+general-anatomy>.*

(Continued)

*Primary Examiner* — Stephen Crow
*Assistant Examiner* — Gregory Winter
(74) *Attorney, Agent, or Firm* — Riverside Law LLP

(57) ABSTRACT

An exercise training device which includes a harness that is worn on the exterior of the foot or shoe of a user, and an elastic resistance cord that releasably attaches to the harness, such that the connection between the elastic resistance cord and harness is positioned at the heel of the user. The exercise training device is used to improve the strength and balance of a user. For example, use of the device improves the throwing motion of a baseball pitcher.

5 Claims, 13 Drawing Sheets

(56) References Cited

U.S. PATENT DOCUMENTS

| | | | | | |
|---|---|---|---|---|---|
| 3,972,238 | A * | 8/1976 | Thatcher | 482/128 |
| 4,974,836 | A * | 12/1990 | Hirsch | 482/40 |
| 5,167,601 | A * | 12/1992 | Frappier | 482/121 |
| 5,490,823 | A * | 2/1996 | Awbrey et al. | 482/55 |
| 5,782,727 | A | 7/1998 | Pierce | |
| 5,836,857 | A * | 11/1998 | Jennings | 482/92 |
| 5,993,362 | A * | 11/1999 | Ghobadi | 482/124 |
| 6,149,559 | A * | 11/2000 | Mackey | 482/124 |
| 8,007,419 | B2 * | 8/2011 | Dieter et al. | 482/124 |
| 8,303,473 | B2 * | 11/2012 | Gutierrez et al. | 482/121 |
| 2003/0130072 | A1 * | 7/2003 | Barth et al. | 473/452 |
| 2005/0032613 | A1 * | 2/2005 | Wehrell | 482/133 |
| 2005/0043150 | A1 | 2/2005 | Nitta et al. | |
| 2006/0265910 | A1 | 11/2006 | Lampley | |
| 2008/0300118 | A1 * | 12/2008 | Wehrell | 482/129 |
| 2010/0050473 | A1 * | 3/2010 | Rosso | 36/97 |
| 2010/0323826 | A1 * | 12/2010 | Lentz, Jr. | 473/452 |

OTHER PUBLICATIONS

"At" definition, <http://dictionary.reference.com/browse/at>.*

* cited by examiner

Figure 9: Throwing Training Regimen
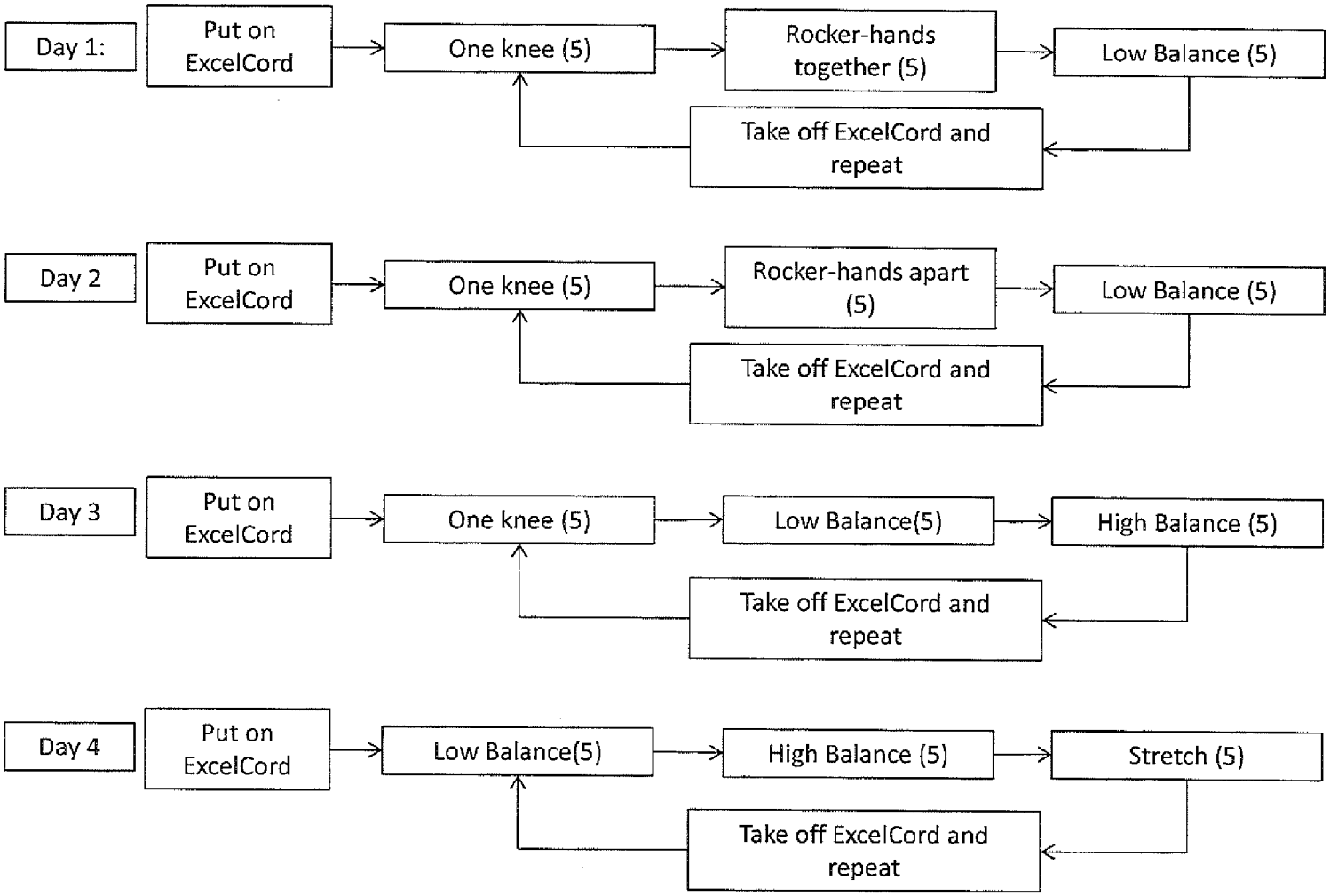

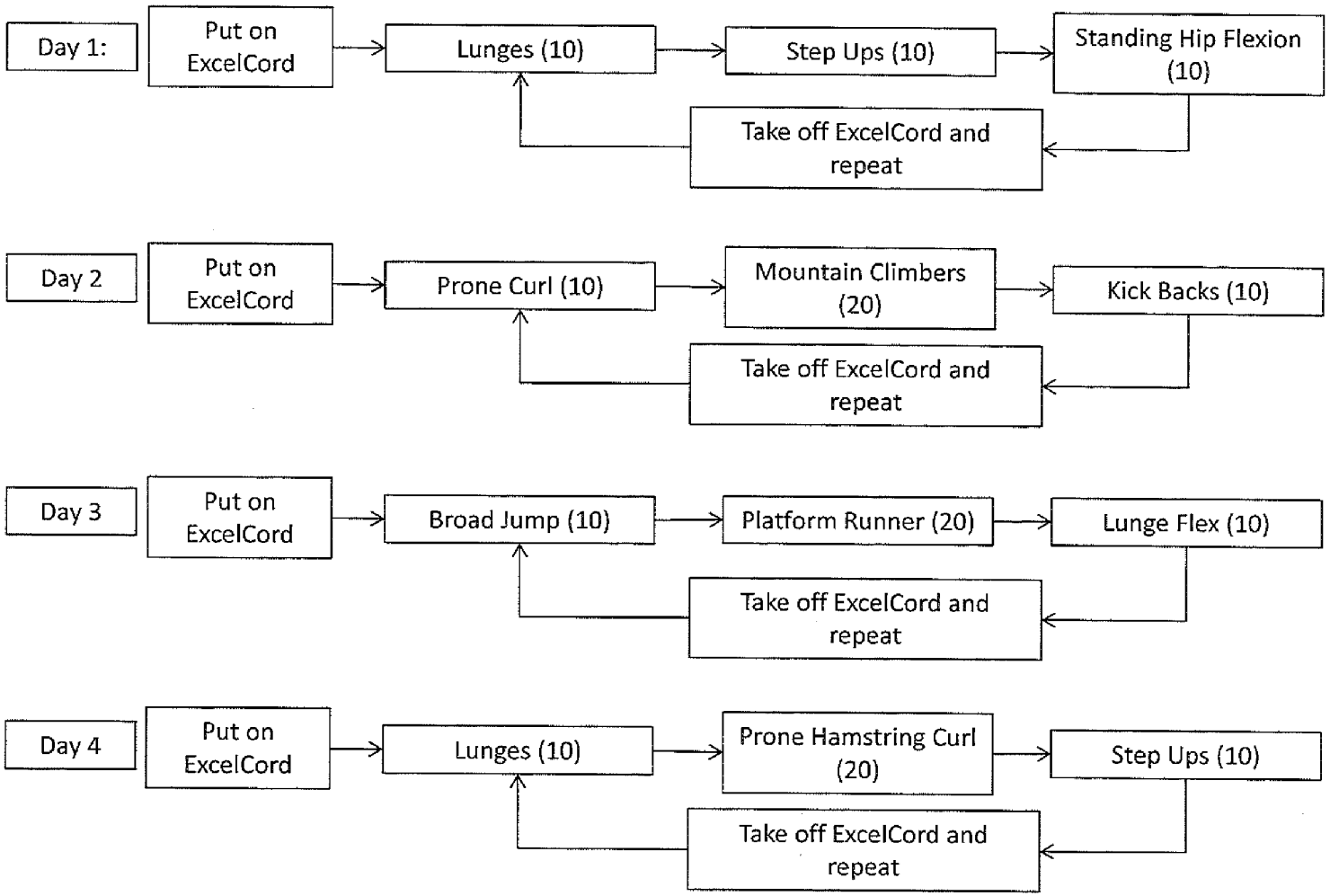
Figure 10: Lower Body Strength Training Regimen

Figure 11: Upper Body Strength Training Regimen
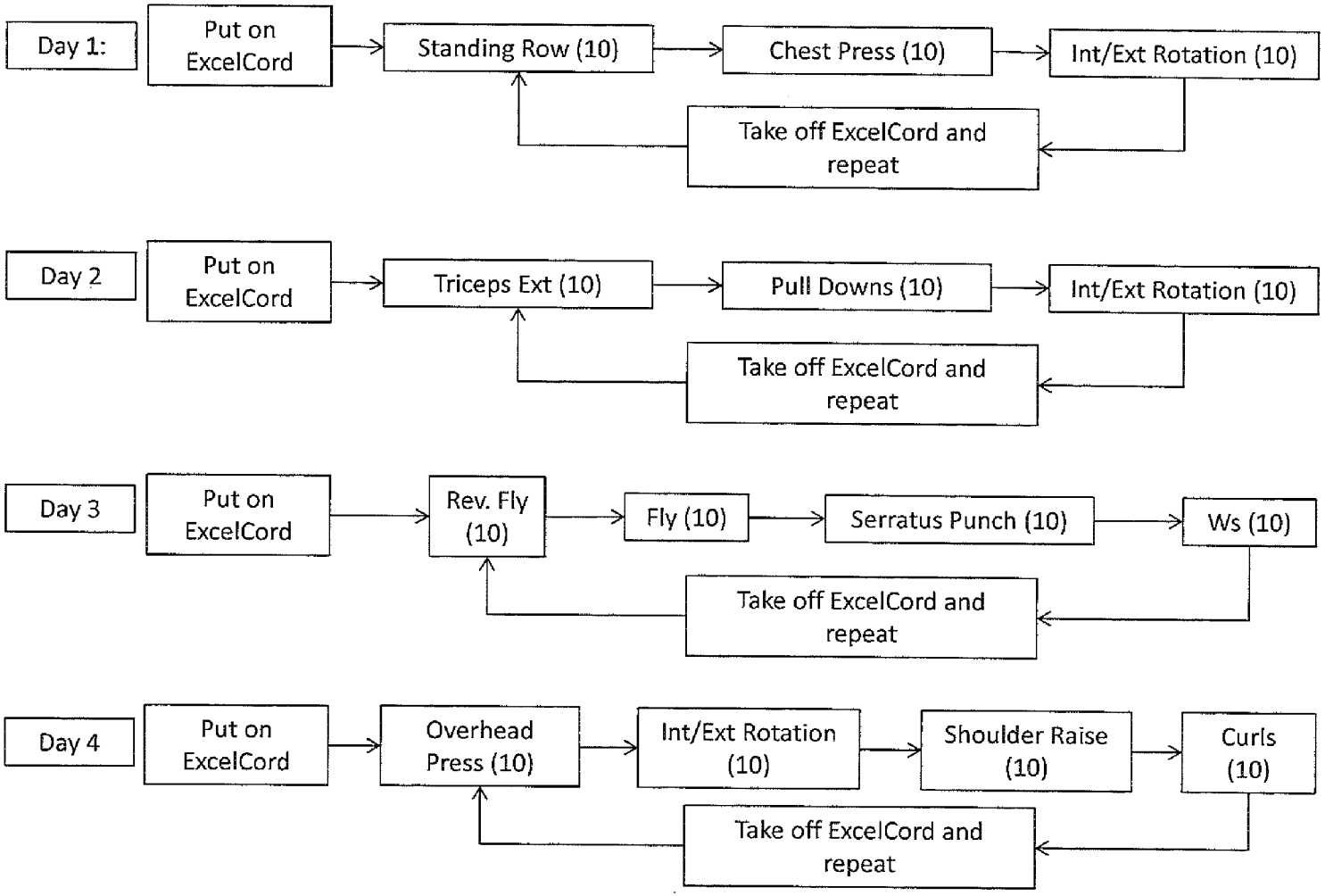

Figure 12: Speed Training Regimen
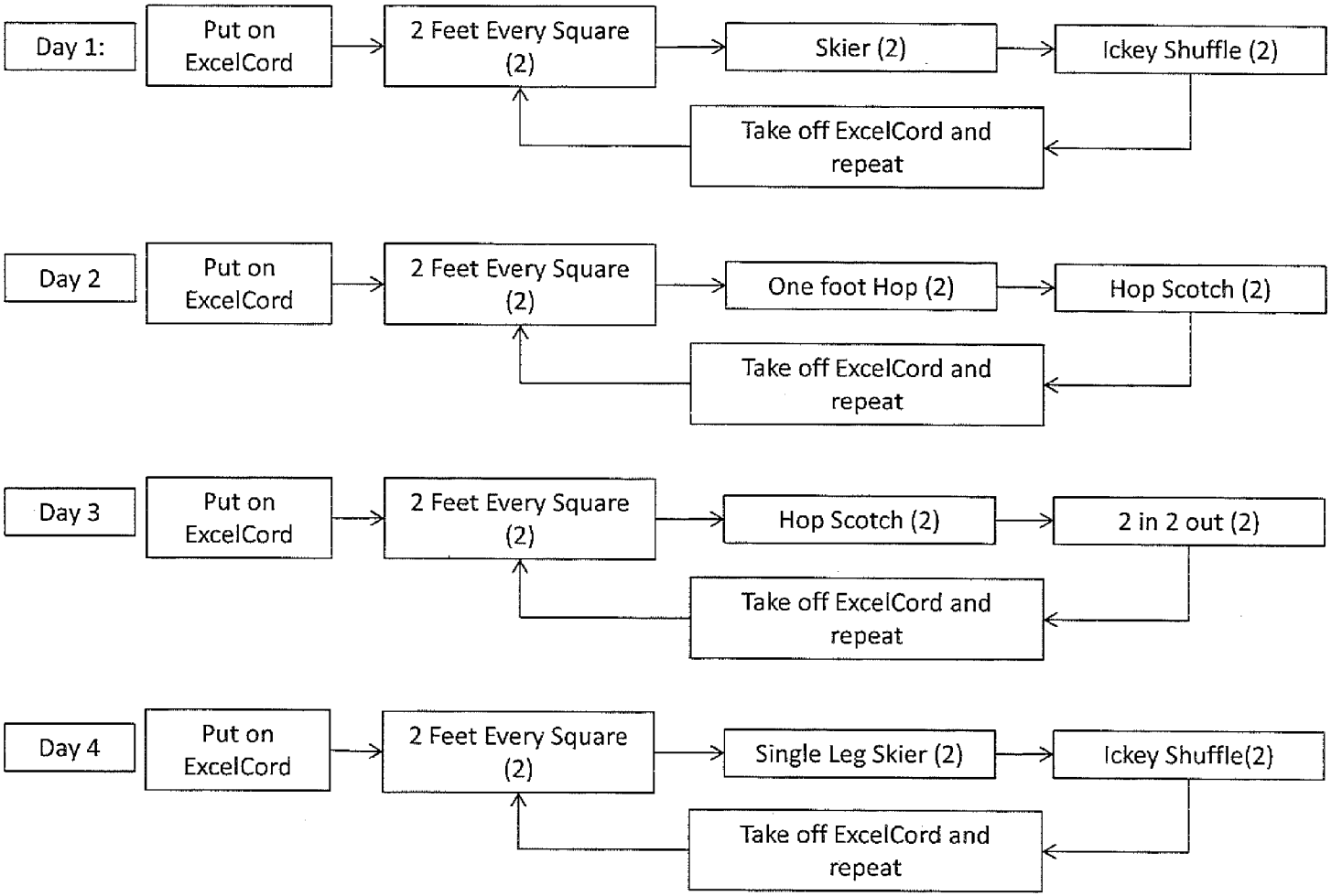

Figure 13: Core Strength Training Regimen
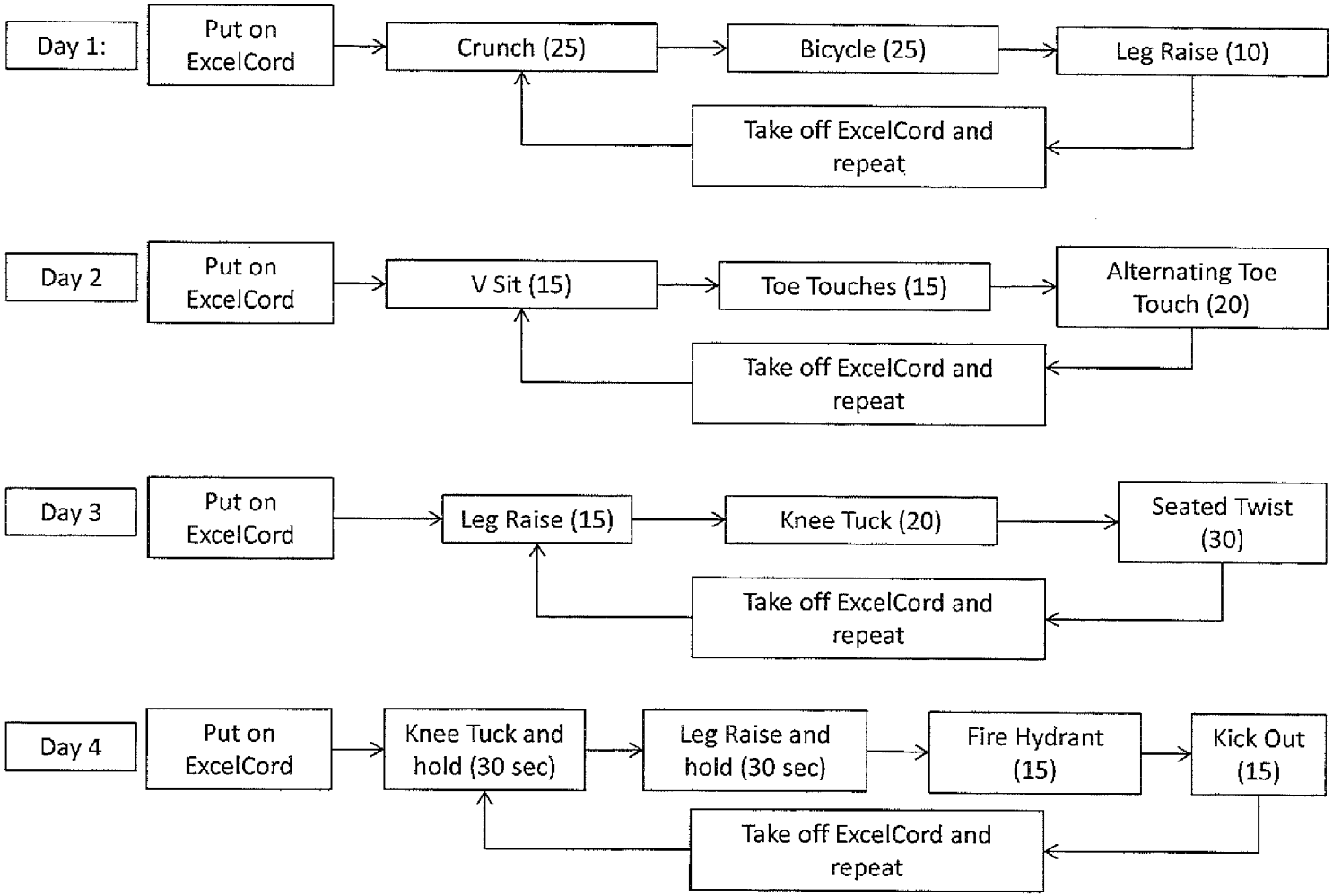

RESISTANCE TRAINING DEVICE AND METHOD OF USE

CROSS-REFERENCE TO RELATED APPLICATIONS

This application claims priority to U.S. Provisional Application No. 61/446,855 filed Feb. 25, 2011, which is hereby incorporated herein by reference in its entirety.

BACKGROUND OF THE INVENTION

Resistance training is any exercise that causes the muscles to contract against an external resistance with the expectation of increases in strength, tone, mass, and/or endurance. The external resistance can be dumbbells, rubber exercise tubing, your own body weight, bricks, bottles of water, or any other object that causes the muscles to contract.

One type of commonly used device for resistance training involves an elastic resistance cord. Typically, the elastic resistance cord is secured to a part of the trainee at one end, and is anchored to a stationary point at the other end. Such use of elastic resistance cords for resistance training exercises is well known for training in the areas of track and field, where the trainee can exert a force against the resistance of the elastic resistance cord as the elastic resistance cord stretches. Currently, resistance cord training is used throughout the recreational, competitive, and professional sports communities. More specifically, resistance cord training can be used in basic strength training, physical therapy, and rehabilitation.

Unfortunately, there has been very little focus on the particular positioning of the attachment point of the resistance cord on the user. For example, U.S. Pat. No. 5,782,727 describes a training device for kicking, which includes a harness strapped over a shoe, and a cord that attaches to a ring on the harness, located above the heel. U.S. Patent Publication No. 2005/0043150 describes an exercise foot harness, which includes coupling points to secure resistance devices to the harness. As described therein, coupling points are located at the toe area, the midportion of the foot, and the heel area. U.S. Patent Publication No. 2006/0265910 describes a training sports shoe, which includes four attachment points configured for the attachment of cables. Attachment points are described to be located at the laces, on the inside, on the outside, and at the rear of the shoe.

These examples of the prior art all describe the attachment of a resistance cord to the area above the heel of the user (i.e. the Achilles). Attachment of the elastic resistance cord at the Achilles limits the range of motion of the user, interferes with the balance of the user, and limits the potential number of angles at which the resistance can be applied.

Further, such elastic resistance cord devices are not commonly used for training athletes with regard to throwing motions. Part of the reason for this, is that the anchoring point on the body for such resistance training would logically be somewhere on the shoulder, length of the arm or hand. Unfortunately, because of the wide range of movement and direction path that the arm must follow, use of these types of devices have not been developed with any meaningful success.

With regard to the throwing motion and mechanics of a baseball pitcher, there is great importance to the strength and balance of the thrower's legs. It is believed that improving the strength of the pitcher's legs, and improving the follow-through motion, will also improve the velocity of the pitch as well as the accuracy of the pitch. Thus, there is a need for a resistance training device that assists athletes with their throwing motion in a way that does not disrupt the full range of movement of the throwing arm and hand. The present invention satisfies this need.

BRIEF DESCRIPTION OF THE DRAWINGS

FIG. 8A and FIG. 8B, depicts the change in the pitching mechanics of the user after use of the device and methods of the invention. The push off leg, after follow-through, is extended higher and more in line with the planting leg after using the device of the present invention. This improved leg extension and balance provides for more consistent throwing mechanics and results in a stronger and more consistently accurate pitch.

FIG. 9 depicts a sample throwing training regimen for use with the device of the invention.

FIG. 10 depicts a sample lower body strength training regimen for use with the device of the invention.

FIG. 11 depicts a sample upper body strength training regimen for use with the device of the invention.

FIG. 12 depicts a sample speed training regimen for use with the device of the invention.

FIG. 13 depicts a sample core strength training regimen for use with the device of the invention.

SUMMARY OF THE INVENTION

Figure 1:
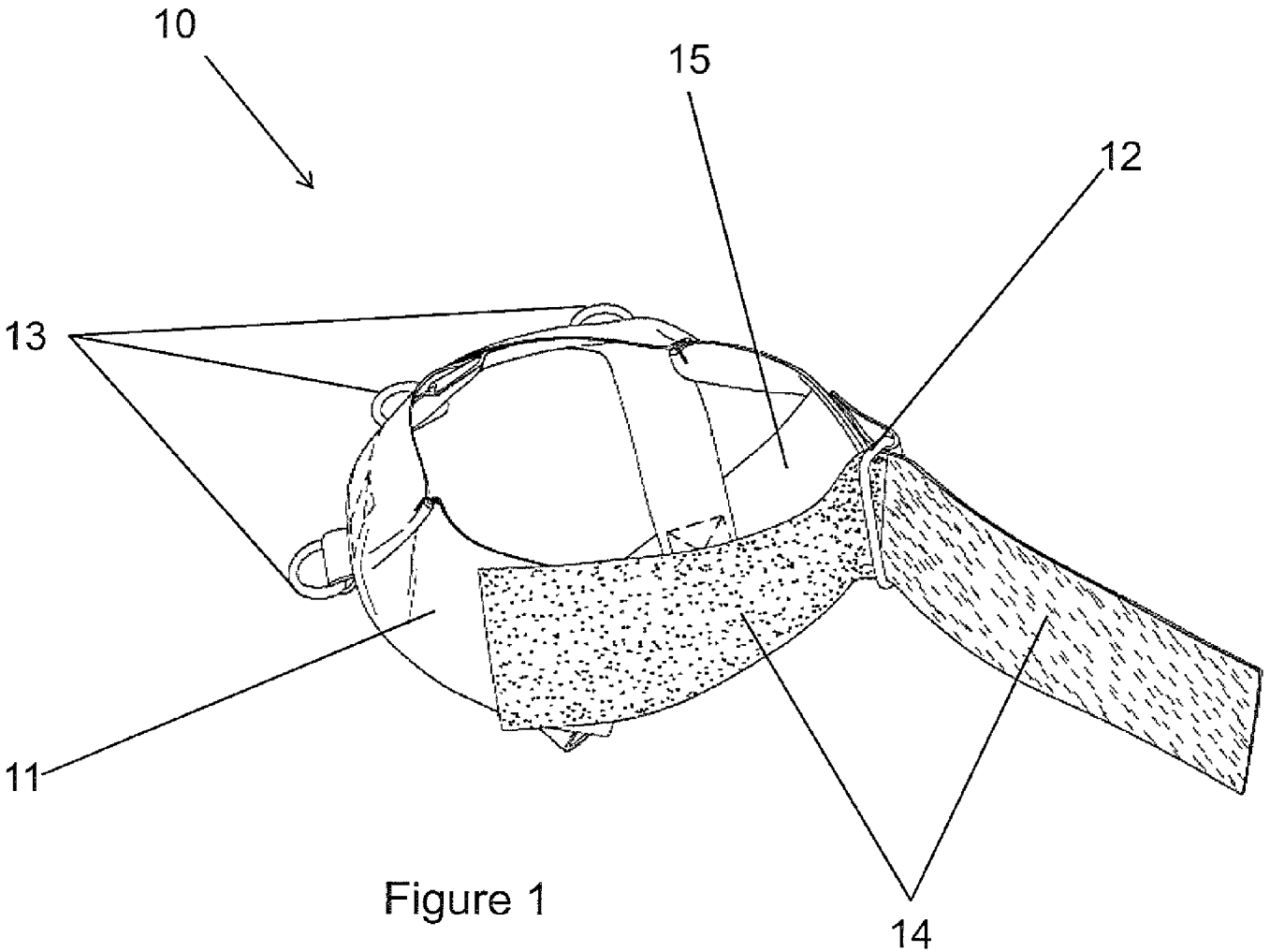
FIG. 1 is a side view of the harness of the invention.
Figure 2:
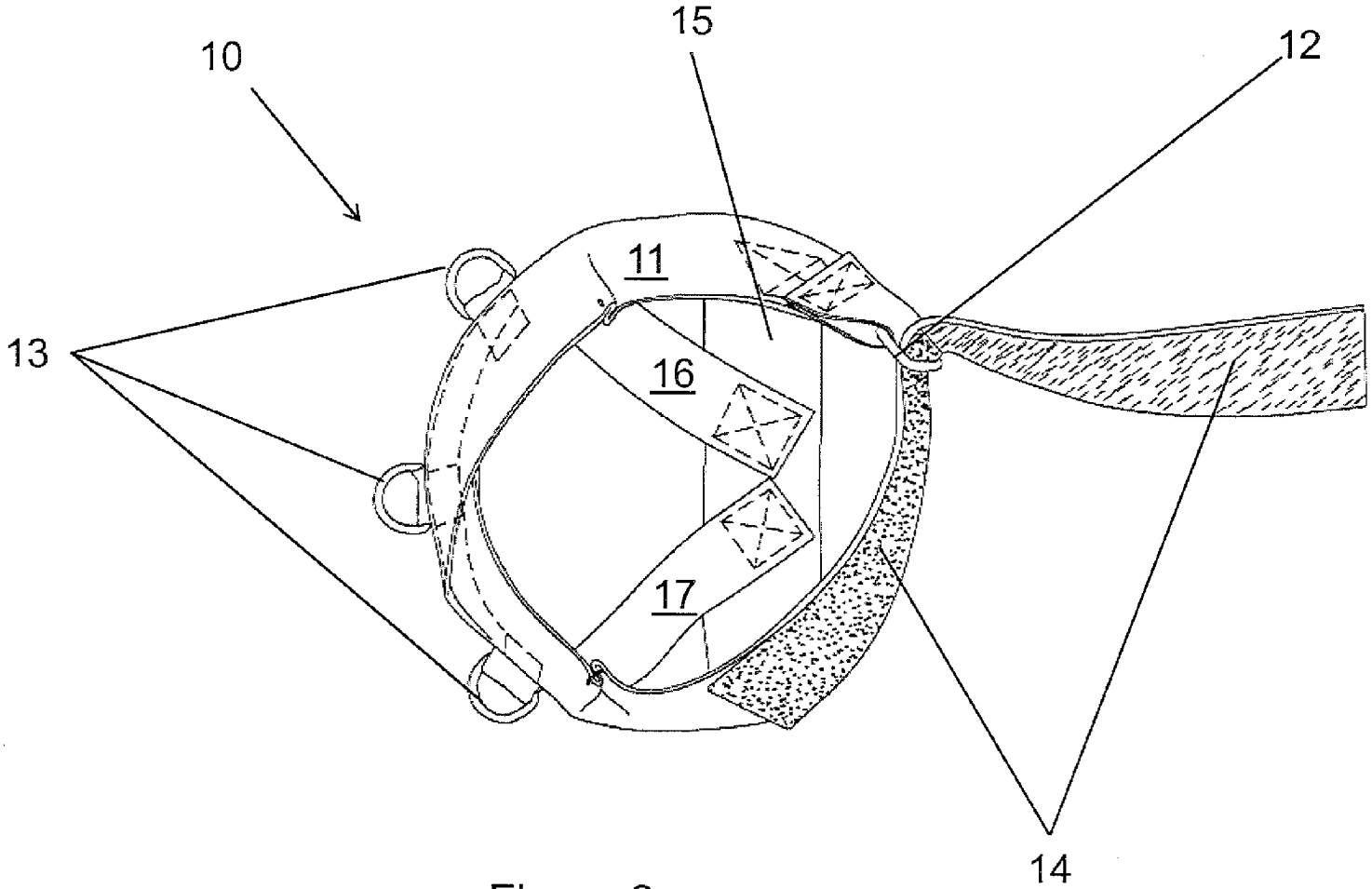
FIG. 2 is a top view of the harness of the invention.
Figure 3:
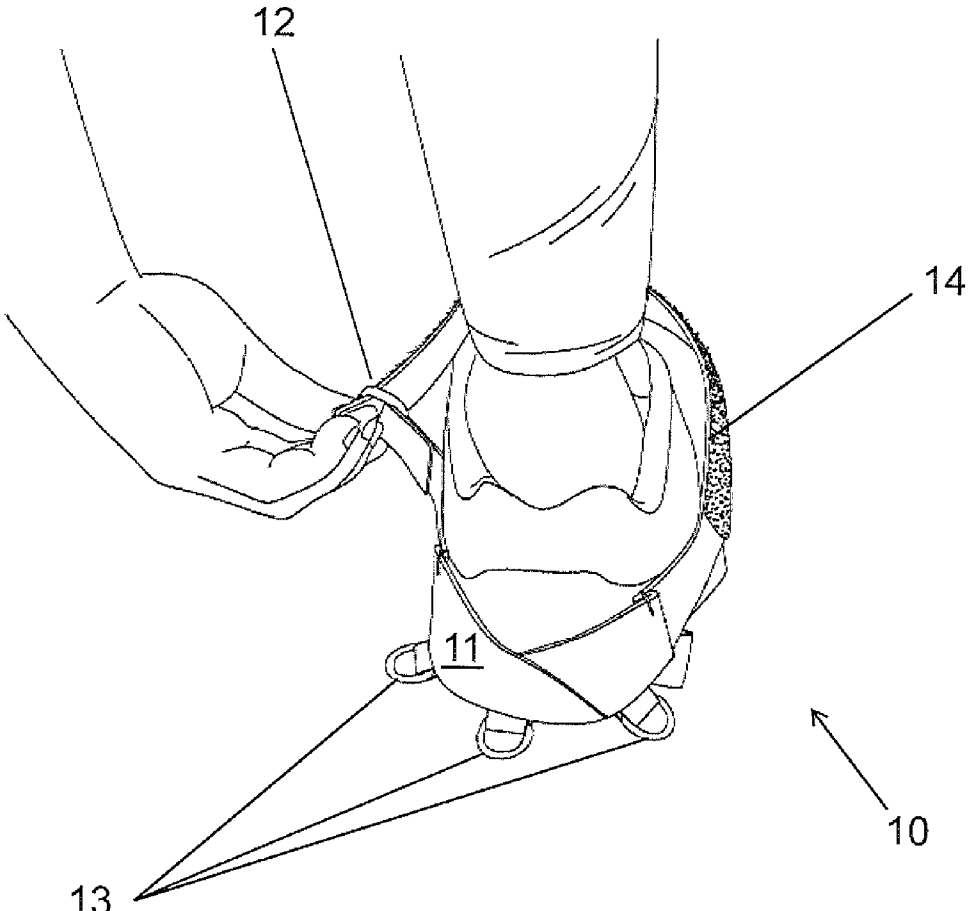
FIG. 3 is a back view of the harness of the invention being releasably attached to the exterior of a shoe of a user.
Figure 4:
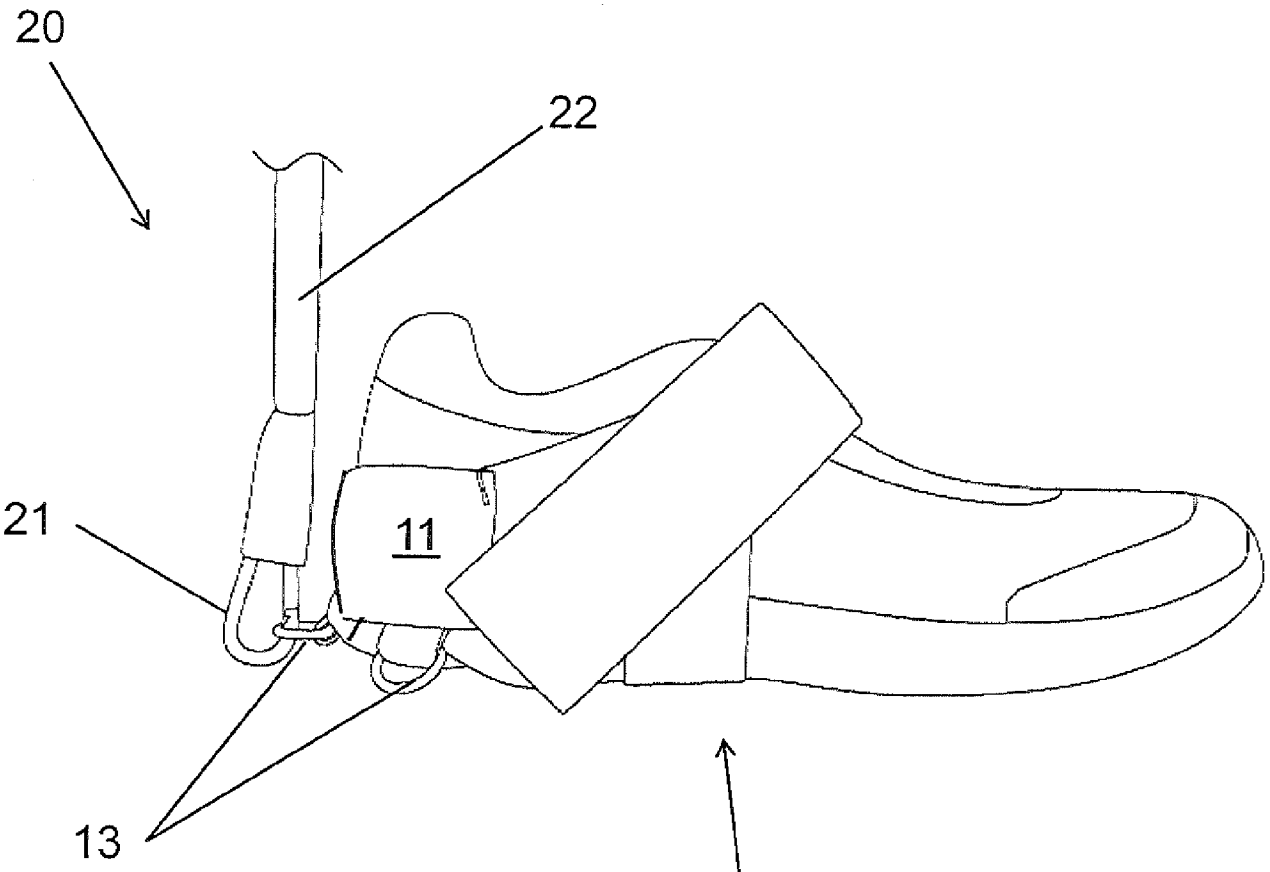
FIG. 4 is a side view of the device of the invention, comprising the harness attached to a shoe and an elastic resistance cord releasably attached to the heel.
Figure 5:
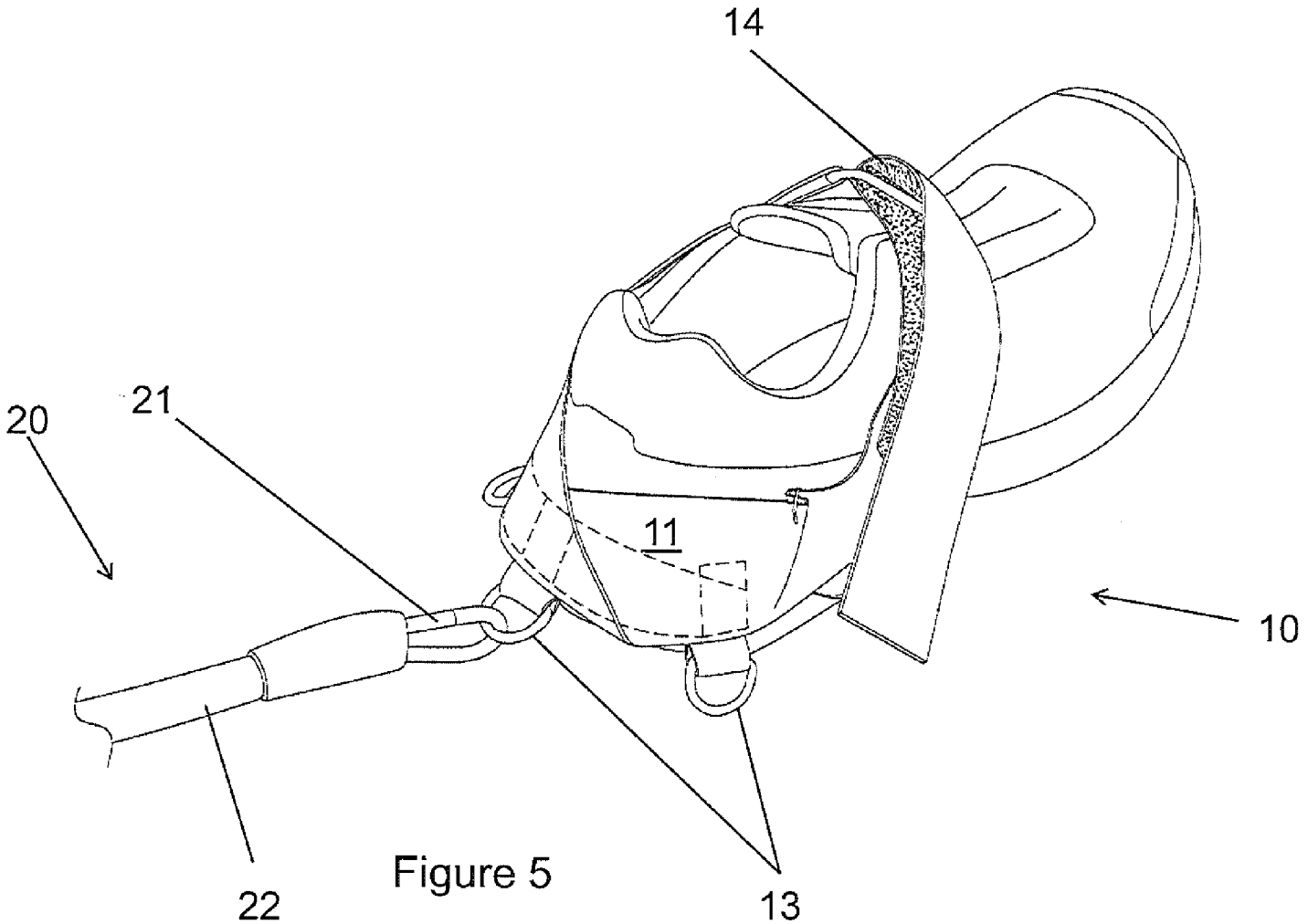
FIG. 5 is a perspective view of the device of the invention, comprising the harness attached to a shoe and an elastic resistance cord releasably attached to the heel.
Figure 6:
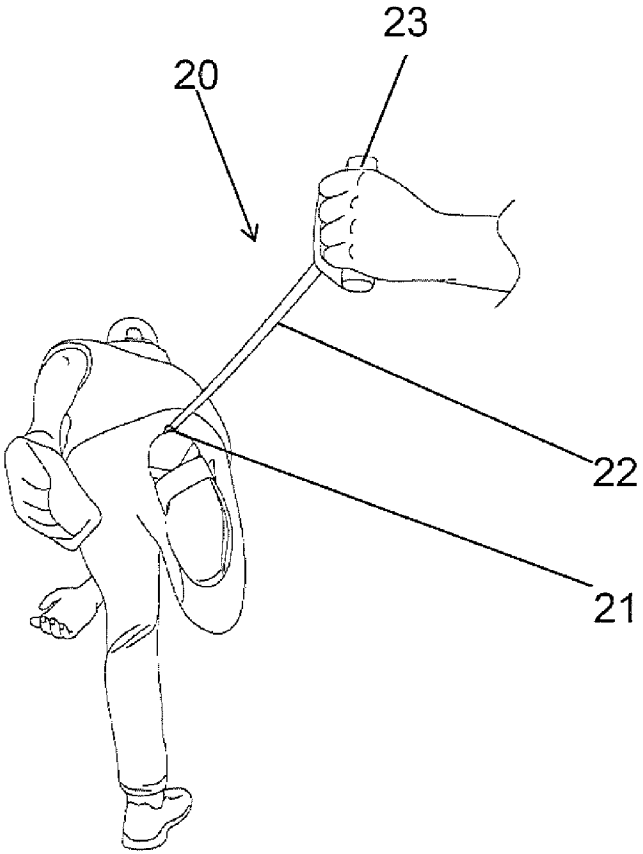
FIG. 6 is a back view of the elastic resistance cord of the invention attached to the harness of the invention during use in the training of the throwing motion of a user.
Figure 7:
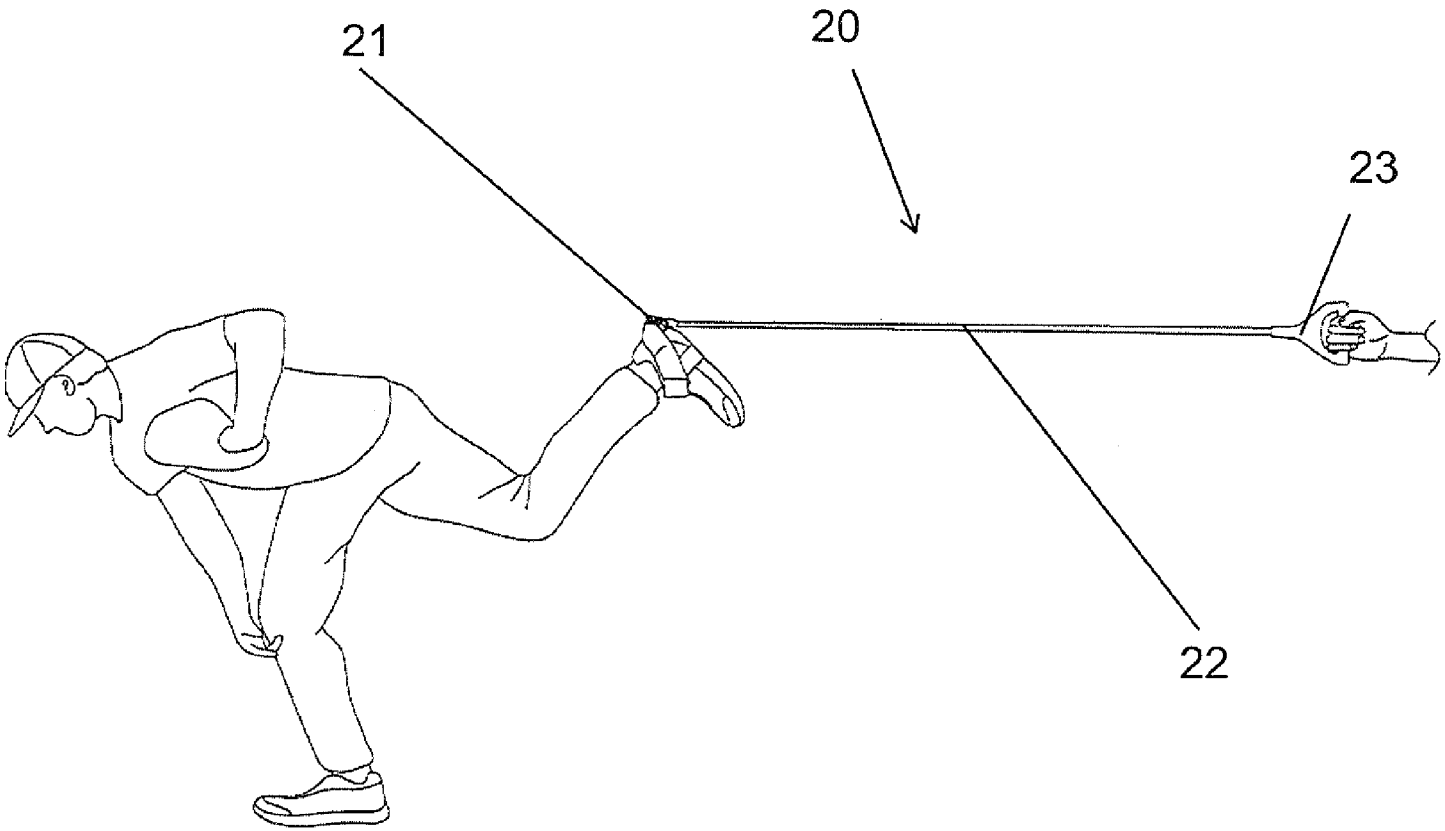
FIG. 7 is a side view of the elastic resistance cord of the invention attached to the harness of the invention during use in the training of the throwing motion of a user.

The present invention includes an exercise training device that includes an elastic resistance cord and a harness. The device includes one end of the elastic resistance cord releasably attached to the harness, where the harness is wearable on the exterior of the foot or footwear of a user. The elastic resistance cord is attached to the harness such that the connection of the elastic resistance cord to the harness is positioned at the heel of the user. The device also includes a second end of the elastic resistance cord that is anchored to an anchoring object separate from the user. In one embodiment, the second end of the elastic resistance cord includes a handle, and the anchoring object is a person holding the handle. In one embodiment, the harness includes at least one attachment point at the heel of the user, where the at least one attachment point is the site for the releasable attachment of the elastic resistance cord. In one embodiment, the at least one attachment point is a D ring. In one embodiment, the harness is made of nylon, polyester, or leather. In one embodiment, the harness includes straps secured to the exterior of the foot or shoe of the user by a hook and loop fastener. In one embodiment, the elastic resistance cord includes latex tubing. In one embodiment, the elastic resistance cord is encased with a fabric sleeve.

The present invention also includes methods for improving the throwing strength and motion of a user. The method includes releasably attaching one end of at least one elastic resistance cord to a harness, where the harness is wearable on the exterior of the foot or footwear of the user. The elastic resistance cord is attached to the harness such that the connection of the elastic resistance cord to the harness is positioned at the heel of the user. The method further includes anchoring the second end of the at least one elastic resistance cord at a distance from the user, such that extension of the elastic resistance cord provides resistance. The method further includes performing at least one throwing exercise through the resistance of the elastic resistance cord.

In one embodiment, the method further includes releasably attaching a first end of at least one additional elastic resistance cord to a second harness, wearable on the exterior of the foot or shoe of a user, such that the connection of the additional resistance cord to the second harness is positioned at the second heel of the user. In one embodiment, the method includes anchoring the additional elastic resistance cord at a distance from the user such that extension of the additional elastic resistance cord provides resistance.

In one embodiment, the method further includes removing the elastic resistance cord from the harness and performing at least one throwing exercise without the resistance of the elastic resistance cord.

In one embodiment, the method includes anchoring the elastic resistance cord to a sturdy stationary object. In one embodiment, the method includes the holding of the elastic resistance cord by a second user. In one embodiment, the second user moves during the throwing exercise thereby moving the point of resistance during the exercise.

The present invention also includes methods for improving the batting strength and motion of a user. The method includes releasably attaching one end of at least one elastic resistance cord to a harness, where the harness is wearable on the exterior of the foot or footwear of the user. The elastic resistance cord is attached to the harness such that the connection of the elastic resistance cord to the harness is positioned at the heel of the user. The method further includes anchoring the second end of the at least one elastic resistance cord at a distance from the user, such that extension of the elastic resistance cord provides resistance. The method further includes performing at least one batting exercise through the resistance of the elastic resistance cord.

The present invention also includes methods for improving the kicking strength and motion of a user. The method includes releasably attaching one end of at least one elastic resistance cord to a harness, where the harness is wearable on the exterior of the foot or footwear of the user. The elastic resistance cord is attached to the harness such that the connection of the elastic resistance cord to the harness is positioned at the heel of the user. The method further includes anchoring the second end of the at least one elastic resistance cord at a distance from the user, such that extension of the elastic resistance cord provides resistance. The method further includes performing at least one kicking exercise through the resistance of the elastic resistance cord.

The present invention also includes methods for improving the upper body strength of a user. The method includes releasably attaching one end of at least one elastic resistance cord to a harness, where the harness is wearable on the exterior of the foot or footwear of the user. The elastic resistance cord is attached to the harness such that the connection of the elastic resistance cord to the harness is positioned at the heel of the user. The method further includes anchoring the second end of the at least one elastic resistance cord at a distance from the user, such that extension of the elastic resistance cord provides resistance. The method further includes performing at least one upper body strength exercise through the resistance of the elastic resistance cord.

The present invention also includes methods for improving the lower body strength of a user. The method includes releasably attaching one end of at least one elastic resistance cord to a harness, where the harness is wearable on the exterior of the foot or footwear of the user. The elastic resistance cord is attached to the harness such that the connection of the elastic resistance cord to the harness is positioned at the heel of the user. The method further includes anchoring the second end of the at least one elastic resistance cord at a distance from the user, such that extension of the elastic resistance cord provides resistance. The method further includes performing at least one lower body strength exercise through the resistance of the elastic resistance cord.

The present invention also includes methods for improving the core strength of a user. The method includes releasably attaching one end of at least one elastic resistance cord to a harness, where the harness is wearable on the exterior of the foot or footwear of the user. The elastic resistance cord is attached to the harness such that the connection of the elastic resistance cord to the harness is positioned at the heel of the user. The method further includes anchoring the second end of the at least one elastic resistance cord at a distance from the user, such that extension of the elastic resistance cord provides resistance. The method further includes performing at least one core strength exercise through the resistance of the elastic resistance cord.

The present invention also includes methods for improving the speed of a user. The method includes releasably attaching one end of at least one elastic resistance cord to a harness, where the harness is wearable on the exterior of the foot or footwear of the user. The elastic resistance cord is attached to the harness such that the connection of the elastic resistance cord to the harness is positioned at the heel of the user. The method further includes anchoring the second end of the at least one elastic resistance cord at a distance from the user, such that extension of the elastic resistance cord provides resistance. The method further includes performing at least one speed exercise through the resistance of the elastic resistance cord.

DETAILED DESCRIPTION

The present invention relates a device for strengthening and balancing the throwing motion of a user. As contemplated herein, the present invention improves the throwing mechanics of a pitcher, particularly a baseball pitcher. These improvements relate to increased leg strength and push off, improved core strength, improved balance, and improved alignment and pitching motion follow-through.

DEFINITIONS

The definitions used in this application are for illustrative purposes and do not limit the scope of the invention.

The articles "a" and "an" are used herein to refer to one or to more than one (i.e. to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, or ±0.1% from the specified value, as such variations are appropriate to perform the disclosed methods.

"Pitching motion" or "pitching mechanics", while used herein to relate primarily to the throwing motions and techniques of a baseball pitcher, may also apply to any throwing motion or technique of a user, and is not limited to any particular sport, or items thrown.

Ranges: throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Description

The present invention is directed to a device for use in training to improve strength, coordination, and conditioning of a user. The device may be referred to herein as the ExcelCord. The ExcelCord is a lightweight foot strap harness equipped with a heel mounted elastic resistance cord. At the other end of the elastic resistance cord is a handle which, in one embodiment, is held by a second user to allow for guided resistance. In another embodiment, the handle is affixed to sturdy object. As such, the device is configured to provide dynamic resistance, static resistance, or a combination thereof during the training of the user. Attachment of the elastic resistance cord at or near the base of the heel prevents hindrance, interference, or disruption of the mechanics of the motion of the user. Thus, the device provides unobtrusive resistance-based methods of training. The device enables the user to improve core strength, leg strength, balance, alignment, endurance, and the like.

As used herein, the "heel" area is referred to the posterior portion of the foot, from the base or sole of the foot and extending upwards up to the point of attachment between the calcaneum and Achilles tendon. At the back of the foot, the area above or proximal to the heel is herein referred to as the "Achilles." The present invention is directed towards a device comprising a harness having a coupling for an elastic resistance cord placed at the heel of the user. The heel is the last part of the body to follow through and complete the pitching motion. Resistance, supplied by way of the elastic resistance cord, applied at the heel provides a ground up approach that does not interfere with the throwing motion of the user. This is in contrast to the attachment of an elastic resistance cord at the Achilles or ankle of user which limits the range of motion, interferes with the throwing motion, and limits the angles of applied resistance. The throwing motion, especially a pitcher's delivery, is a complex, balanced movement, and thus any interruption or interference of proper mechanics will cause a poor throw. Resisting the user specifically from the heel allows for maximum range of motion with minimal mechanical interfering play. In a preferred embodiment, the present invention comprises providing resistance at the lower heel of the user. Heel based resistance starts from the ground up where the throwing motion is initiated.

In one embodiment, the device is used in training to improve the pitching motion of an athlete. In one embodiment, the device provides resistance to the back leg during the pitching delivery thereby increasing the strength and balance of the athlete. In this instance, the elastic resistance cord allows for guidance of the pitching delivery. The device enables the user to improve core strength, leg strength, balance, and alignment. Such improvements enable the user to improve pitching ability, including but not limited to improved accuracy, consistency, and speed of throwing a baseball. With prolonged use of the device of the invention, resisted repetitions of mechanically sound throwing drills increases the strength of the user's muscles, thereby increasing the power generated by the user during pitching. By providing resistance, the device properly aligns a user toward the target, thereby improving balance and correcting a user's bad habits in pitching mechanics.

In another embodiment, the device of the invention is used in training a hitting motion of a baseball player. In this instance, the elastic resistance cord allows for guidance of the leg movement during a swing of the bat. In one embodiment, the device is used to train the front leg. In another embodiment, the device is used to train the back leg. In another embodiment, the device can be worn on both feet, thereby training both legs during the swing. The device enables the user to improve core strength, leg strength, balance, and alignment, thereby improving the swinging motion of the user.

In another embodiment, the device of the invention is used in training the kicking motion of an athlete. In this instance, the elastic resistance cord allows for guidance of the leg movement during a kicking motion. In one embodiment, the device is used to train the kicking leg. In another embodiment, the device is used to train the non-kicking or plant leg. The device enables the user to improve core strength, leg strength, balance, and alignment, thereby improving the kicking motion of the user. In another embodiment, the device can be worn on both feet, thereby training both legs during the kick. Attachment of the elastic resistance cord to various attachment points along the heel enable the guidance of various styles of kicking motions (soccer kick, field goal kick, punting kick, karate kick, etc).

In another embodiment, the device of the invention is used in the strengthening of the swimming stroke of an athlete. In this instance, the elastic resistance cord restricts the swimming motion of a user. The device enables the user to strengthen the core muscles during swimming. Further, attachment of the elastic resistance cord to a sturdy object enables non-stop swimming in an enclosed space, thereby improving endurance.

In another embodiment, the device of the invention is used to improve the quickness, agility, and power of an athlete. In this instance, the device is used to restrict the running movements during various training drills. Resistance of the running motion increases the power generated by the athlete, thereby increasing the quickness of the athlete.

In another embodiment, the device of the invention is used in various upper body, lower body, and core exercises. The device improves the strength, balance, and technique of the athlete when used in conjunction with various exercises known in the art.

According to an aspect of the invention and as shown generally in FIG. 1 through FIG. 5, the present invention includes a foot harness 10, which comprises a first strap 11, a loop 12, attachment points 13, a hook and loop fastener 14, a second strap 15, a third strap 16, and a fourth strap 17. Foot harness 10 is designed to be easily and quickly attached to the foot of a user during the training of the user. As contemplated herein, harness 10 may take the form of a harness that is adjustable, and may be secured over the exterior of a foot, athletic shoe, or athletic cleat. It should be appreciated that harness 10 can be of any design and composed of any material suitable for being releasably secured to the user in a way that creates the anchoring point of the elastic resistance cord at the user's heel. For example, the straps of harness 10 may be constructed of a lightweight, durable material such as nylon, polyester or other fabric. In another example, the straps of harness 10 may be constructed of leather. There is no limitation to the number of straps or sections used in harness 10, so long as the strap is securely and releasably attachable to the exterior of the users shoe or athletic cleat. Harness 10 may likewise be adjustable so that it may fit over any shoe size. Any adjustment mechanism as would be understood by those skilled in the art can be used, including buckles, Velcro and the like.

In one embodiment, harness 10 comprises first strap 11, which, when properly attached to the foot, extends around the back of the user's foot. As described elsewhere herein, first strap 11 can be constructed of any lightweight, durable material including, but not limited to, nylon, polyester, leather, and the like. First strap 11 can be of any length, width, or thickness suitable for supporting the placement of a user's foot in harness 10. In one embodiment, a portion of first strap 11 is structurally reinforced. Portions of first strap 11 that may require reinforcement include areas in which significant force is applied to during use of the device. For example, the portion of first strap 11 that, when harness 10 is attached to a user, exists at the back of the foot is under considerable tension during use of the device. Therefore, in one embodiment, this portion of first strap 11 is reinforced. Reinforcement can be done in any way that strengthens the strap. For example, in one embodiment, a reinforced portion comprises the strap that is folded onto itself, thereby increasing the thickness in that portion. In another embodiment, a reinforced portion comprises additional material that is attached to the strap.

First strap 11 comprises a first end and a second end, where the first end attaches to loop 12 and the second end comprises hook and loop fastener 14. Loop 12 can be of any shape and constructed of any durable material, including metal, durable plastic, or any other durable material. As would be understood by those skilled in the art, a hook and loop fastener generally comprises a hook component and loop component, where pressing the hook component against the loop component attaches the components together. In one embodiment of harness 10, first strap 11 comprises a first component of fastener 14 and a second component of fastener 14. When a user attaches harness 10, first strap 11 is wrapped around the back of the foot, and the second component of fastener 14 is inserted through loop 12. The second component of fastener 14 is then folded back and applied to the first component of fastener 14. In one embodiment, the first component of fastener 14 is the hook component while the second component of fastener 14 is the loop component. In an alternative embodiment, the first component of fastener 14 is the loop component, while the second component of fastener 14 is the hook component. Thus, when the second component of fastener 14 is applied to the first component of fastener 14, first strap 11 is fastened to itself, thereby attaching harness 10 to the foot of the user. Further, fastener 14 provides a mechanism where a user can adjust the fit of harness 10. Whereas the device has been described to comprise a hook and loop fastener, it should be understood that the present invention is not limited to the exact type of fastening mechanism. For example, harness 10 can alternatively comprise buckles, laces, and the like.

The present invention is related to providing elastic resistance at the heel of the user in the training of the user. As such, harness 10 comprises attachment points 13 on first strap 11, where elastic resistance cords are releasably attached. Attachment points 13 are attached to first strap 11 at the portion of strap 11 that, when harness 10 is attached to the foot of a user, exists at the back of the foot, specifically at the heel. In a preferred embodiment, attachment points 13 are positioned at the lower heel of a user. In one embodiment, harness 10 comprises one attachment point 13, located directly at the center of the heel. In another embodiment, harness 10 comprises more than one attachment point 13. As should be understood, harness 10 of the invention is not limited to the number of attachment points 13 attached to the harness. For example, in one embodiment, harness 10 comprises three (3) attachment points 13 at the heel area, with one attachment point 13 located at the center of the heel, while the two (2) other attachment points 13 located to either side of the center. Attachment points 13 can be of any type that supports the removable attachment of an elastic resistance cord. In one embodiment, attachment points 13 are D-rings. However, attachment points 13 can be of any shape and size, as long as they do not shift considerably within the harness. Further, attachment points 13 are not limited as the material which they are constructed. Attachment points 13 can be constructed of any durable material, including metal, durable plastic, and the like.

In one embodiment, harness 10 comprises additional straps that aid in securing harness 10 to the foot of the user. For example, as depicted in Figure X, harness 10 comprises second strap 15, third strap 16, and fourth strap 17 that, when harness 10 is attached to the foot of a user, are located underneath the sole of the shoe of the user. In one embodiment, second strap 15 is a short strap, similar sized to the width of a shoe, and extends from the first end of first strap 11 to the second end of first strap 11. For example, at one end, second strap 15 is attached to the first end of first strap 11 near loop 12, while at the other end, second strap 15 is attached to the second end of first strap 11 near the beginning of hook and loop fastener 14. In one embodiment, third strap 16 and fourth strap 17 extend from second strap 15 to first strap 11. For example, in one embodiment, each of third strap 16 and fourth strap 17 are attached near the center of second strap 15 and extend at some angle to first strap 11. In this aspect, third strap 16 and fourth strap 17 are attached to first strap 11 near the sites of attachment points 13 at the heel of the user. As would be understood by those skilled in the art, second strap 15, third strap 16, and fourth strap 17 can be constructed of the same or of different material than that of first strap 11. Thus, second strap 15, third strap 16, and fourth strap 17 can be of any lightweight, durable material including, but not limited to, nylon, polyester, leather, and the like.

As shown in FIG. 4 through FIG. 7, the device of the invention further comprises an elastic resistance cord 20, which comprises an attachment element 21, a cord 22, and a handle 23. Elastic resistance cord 20 connects to harness 10, such that the connection between resistance cord 20 and harness 10 is positioned at the heel of the user. In a preferred embodiment, the connection between elastic resistance cord 20 and harness 10 is positioned at the lower heel of the user, at or near the sole of the foot. The present invention is also not limited to the number of cords used. For example, two elastic resistance cords, having either the same or different lengths, or elastomeric properties, can be anchored at a single point on the first user's heel, forming a "V" configuration, and each cord having a separate handle for the second user to anchor and/or guide at different positions. In another embodiment, multiple elastic resistance cords 20 can be attached to harness 10, with each elastic resistance cord 20 attached to a different attachment point 13. The elastic resistance cord may also form a "Y" configuration. It should be noted that the present invention is not limited to elastic resistance cord 20 releasably attached to harness 10. For example, in one embodiment of the invention, elastic resistance cord 20 is permanently affixed to harness 20 at attachment point 13 at the heel of a user.

Elastic resistance cord 20 comprises cord 22 which provides the elastic resistance applied to the heel of the user during training. Cord 22 can be of any suitable length necessary for proper training. Further, cord 22 can be constructed of any strong yet elastic material as would be understood by those skilled in the art. Non-limiting examples of materials from which cord 22 can be constructed include rubber, synthetic rubber, latex, nylon, silicone, synthetic elastomer, and composites such as a bungee cord. In one embodiment, cord 22 is a covered cord, comprising a fabric sleeve that surrounds the elastic cord. The covered cord provides a layer of safety in case the elastic cord snaps during use. Cord 22 has a first end and a second end, where the first end is connected to attachment element 21, and the second end is connected to handle 23.

In one aspect, elastic resistance cord 20 is releasably attached to harness 10. In this aspect, elastic resistance cord 20 comprises attachment element 21 that attaches elastic resistance cord 20 to harness 10. Attachment element 21 can include a hook or similar mechanical feature for engaging attachment point 13 on harness 10 in a releasable yet secure manner.

In one embodiment, elastic resistance cord 20 comprises handle 23 connected to the second end of cord 22, Handle 23 can be constructed of any durable material including plastic, wood, metal, and the like. Further, handle 23 can be of any shape such that it is easily grasped by a second user. It should be appreciated that handle 23 is also movable when held by a second user, such that the point or anchor for extension of the cord is guided. For example, the second user grasping handle 23 can hold handle 23 at a fixed point at chest level, waist level, knee-high height, or at ground level. Alternatively, the second user can move and guide the anchor point throughout the pitching motion of the first user, such that the point of resistance and amount of resistance can change, and be optimized for the smoothest resistive movement of the first user. It should also be appreciated that instead of a second user holding handle 23, the second end of cord 22 may be anchored to a stationary point, such as a wall, door, tree, pole, or any other suitable structure to which the elastic resistance cord can be attached. As such, the present invention is not limited to the inclusion of handle 23 in elastic resistance cord 20.

It should be appreciated that any combination of strap, harness, shoe or any other device with a fixed or releasably secured elastic resistance cord anchored specifically at the point of the heel is included in the present invention.

During the pitching delivery, the heel is the last part of the body to follow through and complete the pitching motion. Mounting the cord in other locations, such as at the ankle, disrupts the pictures balance and mechanics during training. This is a key distinction in training pitchers with the proper throwing mechanics, strengthening the user's legs and core muscles, as well as maintaining and improving proper balance and follow-through. The unique heel mounted design of the present invention creates maximum power through balanced resistance training for the throwing motion, particularly baseball pitching mechanics.

According to another aspect of the present invention, the ExcelCord may be used in connection with an exercise regimen uniquely designed for baseball pitching mechanics. For example, upon attachment of the harness to the first user, and the second user holding this handle at the other end of the elastic resistance cord, the first user may execute a first set of throws, such as between 10 and 20 throws, with the second user guiding the point of resistance during the first user's throwing motion. Next, a second set of throws may be performed without attachment of the device. These two sets can be repeated any number of times to maximize resistance training.

Figure 8:
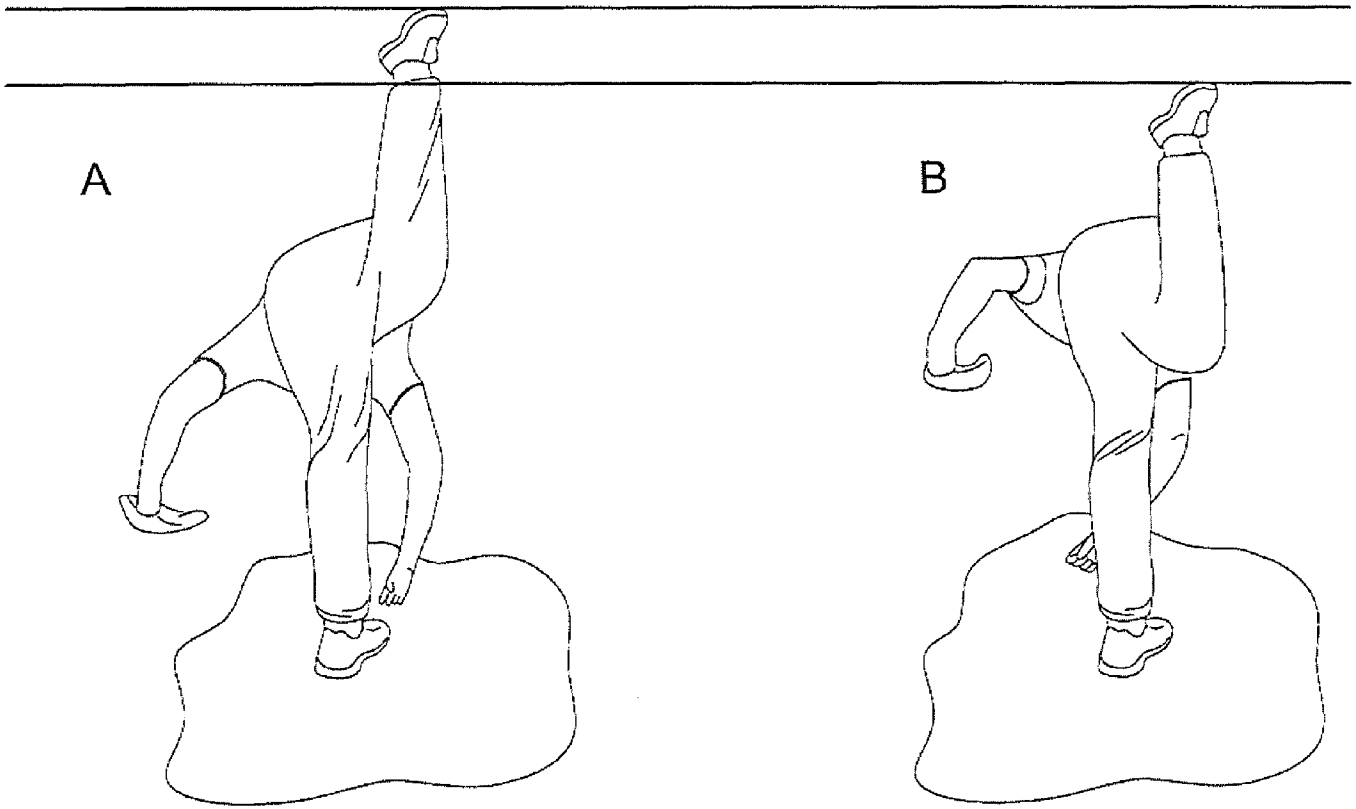
FIG. 8, comprising

As can be seen in the figures provided herein, alignment and balance are improved at the point of follow-through in the pitching motion. For example, the push off leg, after follow-through is extended higher and more in line with the planting leg after using the device of the present invention (FIG. 8). This improved leg extension and balance also provides for more consistent throwing mechanics and results in a stronger and more consistently accurate pitch.

The device of the present invention strengthens core and leg muscles including but not limited to, quadriceps, hamstrings, hip flexor, gluteus maximus, oblique, calf, soleus, peroneals, abdominal, lower back and groin. Use of the present invention also assists in the prevention of core injuries, creates better balance and power, and results in better accuracy throughout the pitching motion. Weight distribution through the pitching motion is also improved, and creates consistent alignment towards the target.

Thus, the present invention also includes a method of improving the strength and pitching mechanics of a user. The method includes the steps of releasably attaching a first end of an elastic resistance cord to the heel of a user, anchoring a second end of the elastic resistance cord at a distance from the user such that extension of the elastic resistance cord provides resistance, and having the user perform at least one throwing or pitching exercise while being resisted through the resistance of the cord. In one embodiment, releasably attaching the elastic resistance cord to the heel of the user comprises attaching the cord to a harness that is placed over the shoe or cleat of a user. In one embodiment, the method comprises releasably attaching an elastic resistance cord to a heel of a user and releasably attaching a second elastic resistance cord to the other heel of the user. In this instance, the second ends of the two elastic resistance cords can be anchored at the same or at different locations. Thus, in one embodiment, resistance to each heel is provided in the same direction, while in an alternative embodiment, resistance to each heel is provided in different directions. In a preferred embodiment, the method comprises attachment of the elastic resistance cord to the lower heel of the user. In one embodiment, the method comprises having the user perform a set of at least one throwing or pitching exercise while being resisted through the resistance of the cord, and then having the user perform the same set of exercises with resistance removed. As would be understood by those skilled in the art, a variety of throwing or pitching exercises can be used in the methods of the invention. Non-limiting examples of pitching exercises include one knee, rocker (hands together or apart), high balance, low balance, and stretch. In one embodiment, the method of the invention includes having the user repeat the throwing exercises, with and without resistance provided by the elastic resistance cord, over a series of days to provide a training regimen. In one embodiment, the throwing training regimen lasts 1 day-14 days. Preferably, the throwing training regimen lasts 2 days-10 days. More preferably, the throwing training regimen lasts 3 days to 7 days. Most preferably, the throwing training regimen lasts 4 days. In one embodiment, the throwing training regimen is repeated as need by the user to improve the strength and mechanics of the pitching motion. The methods of the invention enable resistance training of a user without substantial hindrance or interference of the elastic resistance cord. The methods improve a user's strength, balance, and alignment. The methods further train the user to have proper mechanics while conducting the pitching exercises or drills to ensure that the user is getting the most out of their exercises.

In another aspect, the present invention is directed towards a method of improving the strength and batting mechanics of a user. The method includes the steps of releasably attaching a first end of an elastic resistance cord to the heel of a user, anchoring a second end of the elastic resistance cord at a distance from the user such that extension of the elastic resistance cord provides resistance, and having the user perform at least one batting exercise while being resisted through the resistance of the elastic resistance cord. In one embodiment, releasably attaching the elastic resistance cord to the heel of the user comprises attaching the cord to a harness that is placed over the shoe or cleat of a user. In one embodiment, the method comprises releasably attaching an elastic resistance cord to a heel of a user and releasably attaching a second elastic resistance cord to the other heel of the user. In this instance, the second ends of the two elastic resistance cords can be anchored at the same or at different locations. Thus, in one embodiment, resistance to each heel is provided in the same direction, while in an alternative embodiment, resistance to each heel is provided in different directions. In a preferred embodiment, the method comprises attachment of the elastic resistance cord to the lower heel of the user. In one embodiment, the method comprises having the user perform a set of at least one batting exercise while being resisted through the resistance of the cord, and then having the user perform the same set of exercises with resistance removed. As would be understood by those skilled in the art, a variety of batting exercises can be used in the methods of the invention. Non-limiting examples of batting exercises include live batting practice, hitting off a tee, and the like In one embodiment, the method of the invention includes having the user repeat the batting exercises, with and without resistance provided by the elastic resistance cord, over a series of days to provide a training regimen. In one embodiment, the batting training regimen lasts 1 day-14 days. Preferably, the batting training regimen lasts 2 days-10 days. More preferably, the batting training regimen lasts 3 days to 7 days. Most preferably, the batting training regimen lasts 4 days. In one embodiment, the batting training regimen is repeated as need by the user to improve the strength and mechanics of the batting motion.

In another aspect, the present invention is directed towards a method of improving the strength and kicking mechanics of a user. The method includes the steps of releasably attaching a first end of an elastic resistance cord to the heel of a user, anchoring a second end of the elastic resistance cord at a distance from the user such that extension of the elastic resistance cord provides resistance, and having the user perform at least one kicking exercise while being resisted through the resistance of the cord. In one embodiment, releasably attaching the elastic resistance cord to the heel of the user comprises attaching the cord to a harness that is placed over the shoe or cleat of a user. In one embodiment, the method comprises releasably attaching an elastic resistance cord to a heel of a user and releasably attaching a second elastic resistance cord to the other heel of the user. In this instance, the second ends of the two elastic resistance cords can be anchored at the same or at different locations. Thus, in one embodiment, resistance to each heel is provided in the same direction, while in an alternative embodiment, resistance to each heel is provided in different directions. In a preferred embodiment, the method comprises attachment of the elastic resistance cord to the lower heel of the user. In one embodiment, the method comprises having the user perform a set of at least one kicking exercise while being resisted through the resistance of the cord, and then having the user perform the same set of exercises with resistance removed. As would be understood by those skilled in the art, a variety of kicking exercises can be used in the methods of the invention. Non-limiting examples of kicking exercises include field goal kicking, punting, soccer kicking drills, karate kicks, and the like. In one embodiment, the method of the invention includes having the user repeat the kicking exercises, with and without resistance provided by the elastic resistance cord, over a series of days to provide a training regimen. In one embodiment, the kicking training regimen lasts 1 day-14 days. Preferably, the kicking training regimen lasts 2 days-10 days. More preferably, the kicking training regimen lasts 3 days to 7 days. Most preferably, the kicking training regimen lasts 4 days. In one embodiment, the kicking training regimen is repeated as need by the user to improve the strength and mechanics of the kicking motion.

In another aspect, the present invention is directed towards a method of improving the lower body strength of a user. The method includes the steps of releasably attaching a first end of an elastic resistance cord to the heel of a user, anchoring a second end of the elastic resistance cord at a distance from the user such that extension of the elastic resistance cord provides resistance, and having the user perform at least one lower body strength exercise while being resisted through the resistance of the cord. In one embodiment, releasably attaching the elastic resistance cord to the heel of the user comprises attaching the cord to a harness that is placed over the shoe or cleat of a user. In one embodiment, the method comprises releasably attaching an elastic resistance cord to a heel of a user and releasably attaching a second elastic resistance cord to the other heel of the user. In this instance, the second ends of the two elastic resistance cords can be anchored at the same or at different locations. Thus, in one embodiment, resistance to each heel is provided in the same direction, while in an alternative embodiment, resistance to each heel is provided in different directions. In a preferred embodiment, the method comprises attachment of the elastic resistance cord to the lower heel of the user. In one embodiment, the method comprises having the user perform a set of at least one lower body strength exercise while being resisted through the resistance of the cord, and then having the user perform the same set of exercises with resistance removed. As would be understood by those skilled in the art, a variety of lower body strength exercises can be used in the methods of the invention. Non-limiting examples of lower body strength exercises include hinges, step ups, kick backs, mountain climbers, lunge flex, lunge and twist, and the like. In one embodiment, the method of the invention includes having the user repeat the lower body strength exercises, with and without resistance provided by the elastic resistance cord, over a series of days to provide a training regimen. In one embodiment, the lower body strength training regimen lasts 1 day-14 days. Preferably, the lower body strength training regimen lasts 2 days-10 days. More preferably, the lower body strength training regimen lasts 3 days to 7 days. Most preferably, the lower body strength training regimen lasts 4 days. In one embodiment, the lower body strength training regimen is repeated as need by the user to improve lower body strength.

In another aspect, the present invention is directed towards a method of improving the upper body strength of a user. The method includes the steps of releasably attaching a first end of an elastic resistance cord to the heel of a user, anchoring a second end of the elastic resistance cord at a distance from the user such that extension of the elastic resistance cord provides resistance, and having the user perform at least one upper body strength exercise while being resisted through the resistance of the cord. In one embodiment, releasably attaching the elastic resistance cord to the heel of the user comprises attaching the cord to a harness that is placed over the shoe or cleat of a user. In one embodiment, the method comprises releasably attaching an elastic resistance cord to a heel of a user and releasably attaching a second elastic resistance cord to the other heel of the user. In this instance, the second ends of the two elastic resistance cords can be anchored at the same or at different locations. Thus, in one embodiment, resistance to each heel is provided in the same direction, while in an alternative embodiment, resistance to each heel is provided in different directions. In a preferred embodiment, the method comprises attachment of the elastic resistance cord to the lower heel of the user. In one embodiment, the method comprises having the user perform a set of at least one upper body strength exercise while being resisted through the resistance of the cord, and then having the user perform the same set of exercises with resistance removed. As would be understood by those skilled in the art, a variety of upper body strength exercises can be used in the methods of the invention. Non-limiting examples of upper body strength exercises include standing row, chest press, Internal Rotation, External Rotation, Triceps Extension, Pull downs, Fly, Reverse Fly, Serratus Punch, W's Overhead Press, Shoulder Raise, Curls, and the like. In one embodiment, the method of the invention includes having the user repeat the upper body strength exercises, with and without resistance provided by the elastic resistance cord, over a series of days to provide a training regimen. In one embodiment, the upper body strength training regimen lasts 1 day-14 days. Preferably, the upper body strength training regimen lasts 2 days-10 days. More preferably, the upper body strength training regimen lasts 3 days to 7 days. Most preferably, the upper body strength training regimen lasts 4 days. In one embodiment, the upper body strength training regimen is repeated as need by the user to improve upper body strength.

In another aspect, the present invention is directed towards a method of improving the speed of a user. The method includes the steps of releasably attaching a first end of an elastic resistance cord to the heel of a user, anchoring a second end of the elastic resistance cord at a distance from the user such that extension of the elastic resistance cord provides resistance, and having the user perform at least one speed exercise while being resisted through the resistance of the cord. In one embodiment, releasably attaching the elastic resistance cord to the heel of the user comprises attaching the cord to a harness that is placed over the shoe or cleat of a user. In one embodiment, the method comprises releasably attaching an elastic resistance cord to a heel of a user and releasably attaching a second elastic resistance cord to the other heel of the user. In this instance, the second ends of the two elastic resistance cords can be anchored at the same or at different locations. Thus, in one embodiment, resistance to each heel is provided in the same direction, while in an alternative embodiment, resistance to each heel is provided in different directions. In a preferred embodiment, the method comprises attachment of the elastic resistance cord to the lower heel of the user. In one embodiment, the method comprises having the user perform a set of at least one speed exercise while being resisted through the resistance of the cord, and then having the user perform the same set of exercises with resistance removed. As would be understood by those skilled in the art, a variety of speed exercises can be used in the methods of the invention. Non-limiting examples of speed exercises include 2 feet every square, One foot hop, Ickey Shuffle, Skier, Sideways crossover, Hop Scotch, 2 in 2 out, Single leg skier, and the like. In one embodiment, the method of the invention includes having the user repeat the speed exercises, with and without resistance provided by the elastic resistance cord, over a series of days to provide a training regimen. In one embodiment, the speed training regimen lasts 1 day-14 days. Preferably, the speed training regimen lasts 2 days-10 days. More preferably, the speed training regimen lasts 3 days to 7 days. Most preferably, the speed training regimen lasts 4 days. In one embodiment, the speed training regimen is repeated as need by the user to improve speed.

In another aspect, the present invention is directed towards a method of improving the core strength of a user. The method includes the steps of releasably attaching a first end of an elastic resistance cord to the heel of a user, anchoring a second end of the elastic resistance cord at a distance from the user such that extension of the elastic resistance cord provides resistance, and having the user perform at least one core strength exercise while being resisted through the resistance of the cord. In one embodiment, releasably attaching the elastic resistance cord to the heel of the user comprises attaching the cord to a harness that is placed over the shoe or cleat of a user. In one embodiment, the method comprises releasably attaching an elastic resistance cord to a heel of a user and releasbly attaching a second elastic resistance cord to the other heel of the user. In this instance, the second ends of the two elastic resistance cords can be anchored at the same or at different locations. Thus, in one embodiment, resistance to each heel is provided in the same direction, while in an alternative embodiment, resistance to each heel is provided in different directions. In one embodiment, the method comprises having the user perform a set of at least one core strength exercise while being resisted through the resistance of the cord, and then having the user perform the same set of exercises with resistance removed. As would be understood by those skilled in the art, a variety of core strength exercises can be used in the methods of the invention. Non-limiting examples of core strength exercises include crunches, bicycle, leg raise, V sit, toe touches, alternating toe touches, leg raises, knee tucks, seated twists, static knee tucks, static leg raises, fire hydrants, kick outs, and the like. In one embodiment, the method of the invention includes having the user repeat the core strength exercises, with and without resistance provided by the elastic resistance cord, over a series of days to provide a training regimen. In one embodiment, the core strength training regimen lasts 1 day-14 days. Preferably, the core strength training regimen lasts 2 days-10 days. More preferably, the core strength training regimen lasts 3 days to 7 days. Most preferably, the core strength training regimen lasts 4 days. In one embodiment, the core strength training regimen is repeated as need by the user to improve core strength.

EXPERIMENTAL EXAMPLES

The invention is further described in detail by reference to the following experimental examples. These examples are provided for purposes of illustration only, and are not intended to be limiting unless otherwise specified. Thus, the invention should in no way be construed as being limited to the following examples, but rather, should be construed to encompass any and all variations which become evident as a result of the teaching provided herein.

Without further description, it is believed that one of ordinary skill in the art can, using the preceding description and the following illustrative examples, make and utilize the compounds of the present invention and practice the claimed methods. The following working examples therefore, specifically point out the preferred embodiments of the present invention, and are not to be construed as limiting in any way the remainder of the disclosure.

Example 1

Throwing Training Regimen

A suggested four day training regimen is provided for use in the training of the throwing or pitching motion of a user (FIG. 9).

On each day, the ExcelCord training device is strapped around the front foot, back foot, or both feet of the user. Prior to training on each day, warm-up and stretching is done as below:

Warm-up: high knees (20 repetitions), butt kicks (20), lunges (10), internal rotation (10), external rotation (10)

Stretch: triceps, back, hamstrings, quadriceps, groin

Exercises performed with the ExcelCord device attached on day 1 through day 4 are performed as below.

Day 1: 2 sets of—One knee (5), Rocker-hands together (5), and low balance (5)

Day 2: 2 sets of—One knee (5), Rocker-hands apart (5), and low balance (5)

Day 3: 2 sets of—One knee (5), low balance (5), and high balance (5)

Day 4: 2 sets of—Low balance (5), high balance (5), and stretch (5)

Sets of each exercise can be repeated without the ExcelCord attached.

Brief descriptions of the above exercises are provided below:

High Knees: Start with feet shoulder width apart then alternate bringing knees as high as possible while running. Perform a high knee with both legs to complete one repetition.

Butt Kicks: Start with feet shoulder width apart then alternate kicking heel against upper thigh while using proper running form. Perform a butt kick with both legs to complete one repetition.

Lunges: Start with feet shoulder width apart then step out 2-3 feet landing on the ball of foot. Upon landing sink hips so front thigh is parallel to the floor and the back knee is barely touching the floor. Staying balanced and under control, step back and switch legs.

Internal Rotation: Balancing on one leg, with arm at a 90 degree angle, rotate arm until palm is facing down.

External Rotation: Balancing on one leg, with arm at a 90 degree angle starting palm down, rotate arm back until palm is facing anchoring point of the ExcelCord.

Stretch position: Start with glove side shoulder facing the target and perform pitching delivery.

One Knee: Start on one knee, chest facing the target with hands together. Rock forward then back to create rhythm and begin the throwing motion. Transfer weight towards the target, throw, and stand up on front foot.

Rocker: In a wide athletic stance, front toe is pointed towards the target while keeping the back foot parallel with the pitching rubber. With hands separated rock forward to create rhythm. As weight comes forward, begin the throwing motion. Transfer weight towards target and release the ball while staying balanced over front leg. Rocker Drill can also be performed starting with hands together.

Low balance: Start from the stretch position with front foot slightly off the ground in a "low" balance position. Hold this position for at least two seconds before beginning pitching delivery.

High balance position: Start from the stretch position with your front leg raised in the "high" balance position. Hold this position for at least two seconds before beginning pitching delivery.

Example 2

Lower Body Strength Training Regimen

A suggested four day training regimen is provided for use in improving the lower body strength of a user (FIG. 10).

On each day, the ExcelCord training device is strapped around the right foot, left foot, or both feet of the user. Prior to training on each day, warm-up and stretching is done as below:

Warm-up: high knees (20 repetitions), butt kicks (20), hinges (10), internal rotation (10), external rotation (10)

Stretch: triceps, back, hamstrings, quadriceps, groin

Exercises performed with the ExcelCord device attached on day 1 through day 4 are performed as below.

Day 1: 2 sets of—Lunges (10), Step Ups (10), and Standing Hip Flexion (10)

Day 2: 2 sets of—Prone Curl (10), Mountain Climbers (20), and Kick Backs (10)

Day 3: 2 sets of—Broad Jump (10), Platform Runner (20), and Lunge Flex (10)

Day 4: 2 sets of—Lunges (10), Prone Hamstring Curl (20), and Step Ups (10)

Sets of each exercise can be repeated without the ExcelCord attached.

Brief descriptions of the above exercises are provided below:

Step Ups: Start with feet shoulder width apart then step on to platform with entire foot. Lift back knee towards chest.

Kick Backs: Start facing the anchoring point of the ExcelCord in an athletic stance or on all fours. While maintaining posture and technique, alternate extending each foot away from the anchoring point.

Lunges: Start with feet shoulder width apart facing away from the anchoring point of the ExcelCord. Step out and sink hips so front thigh is parallel to the floor and the back knee is barely touching the floor, Maintaining posture and technique, step back and switch legs.

Lunge Flex: Start in push up position with core tight and hips low. Bring foot straight up and place it to the outside of the hand. Hold for a one count before returning foot and alternating.

Mountain climbers: Start in push up position with core tight and hips low. Alternate bringing feet forward and back minimizing any hip movement. One repetition is complete when both feet have gone forward and back.

Standing Hip flexion: Start with feet shoulder width apart in an athletic stance. While facing away from the anchoring point of the ExcelCord, lift knee to chest maintaining posture and balance.

Prone curl: Start facing away from the anchoring point of the ExcelCord, lying face down with legs straight. Alternating or at the same time bring each heel to the upper thigh to complete one repetition.

Broad jump: Start with feet shoulder width apart in an athletic stance. Facing away from the anchoring point of the ExcelCord, jump out and land on the balls of both feet while maintaining balance and posture.

Platform Runner: Facing away from the anchoring point of the ExcelCord, stand in front of the elevated surface. Alternate touching each foot to the top of the elevated surface in a running motion maintaining balance and technique.

Example 3

Upper Body Strength Training Regimen

A suggested four day training regimen is provided for use in improving the upper body strength of a user (FIG. 11).

On each day, the ExcelCord training device is strapped around the right foot, left foot, or both feet of the user. Prior to training on each day, warm-up and stretching is done as below:

Warm-up: high knees (20 repetitions), butt kicks (20), lunges (10), internal rotation (10), external rotation (10)

Stretch: triceps, back, hamstrings, quadriceps, groin

Exercises performed with ExcelCord device attached, in conjunction with additional traditional resistance cords, on day 1 through day 4 are performed as below.

Day 1: 2 sets of—Standing Row (10), Chest Press (10), internal rotation (10), and external rotation (10)

Day 2: 2 sets of—triceps extension (10), pull downs (10), wrist (10), internal rotation (10), and external rotation (10)

Day 3: 2 sets of Reverse Fly (10), Fly (10), Seratis Punch (10), and W's (10)

Day 4: 2 sets of—Overhead press (10), internal rotation (10), external rotation (10), shoulder raise (10), and curls (10)

Sets of each exercise can be repeated without the ExcelCord attached.

Brief descriptions of the above exercises are provided below:

Standing Row: With feet shoulder with apart or balancing on one leg facing the ExcelCord resistance pull the handles until elbows are behind back and shoulders are pinched together.

Chest Press: Balancing on one leg facing away from the ExcelCord resistance, start with the handles at chest pushing away extending arms out in front of you.

Triceps Extension: Balancing on one leg, facing the ExcelCord resistance, grasp other resistance cord and pull down, while keeping elbows in. Straighten arms until fully extended.

Pull-downs: Balancing on one leg facing the ExcelCord resistance, grasp the handles of other resistance cord. Pull the handles down to at least shoulder level, keeping elbows in and back straight.

Wrist Rotation: Balancing on one leg facing the ExcelCord resistance, grasp handle of other resistance cord and alternate flexing and extending each wrist.

Reverse Fly: Balancing on one leg facing the ExcelCord resistance, start with arms straight out in front bringing hands behind back pinching shoulder blades together.

Fly: Balancing on one leg facing away from the ExcelCord resistance, start with arms out to the side then bring hands together and repeat.

Serratus Punch: Balancing on one leg facing away from the ExcelCord resistance, hold handle of weight or other resistance cord in front. Extend shoulder blade forward while keeping arm straight.

W's: Balancing on one leg facing the ExcelCord resistance, start with elbows tucked against side with thumbs pointing up. Pinch shoulder blades and scapula together, then relax, for one repetition.

Overhead Press: Balancing on one leg, start with handles of weights or resistance cord at shoulder level then press upwards extending arms overhead.

Shoulder Raise: Balancing on one leg, start with handles of weights or resistance cord in front in a low position. Raise handles with arms extended until parallel with ground.

Curls: Balancing on one leg facing the ExcelCord resistance grasp the handles of weights or other resistance cord with arms straight. Pull the handle up bending at the elbow bringing the handle towards the shoulder.

Example 4

Speed Training Regimen

A suggested four day training regimen is provided for use in improving the speed of a user (FIG. 12).

On each day, the ExcelCord training device is strapped around the right foot, left foot, or both feet of the user. Prior to training on each day, warm-up and stretching is done as below:

Warm-up: high knees (20 repetitions), butt kicks (20), lunges (10), lunge flex (10)

Stretch: triceps, back, hamstrings, quadriceps, groin

Exercises performed with the ExcelCord device attached on day 1 through day 4 are performed as below.

Day 1: 2 sets of—2 Feet Every Square (2), Skier (2), and Ickey Shuffle (2)

Day 2: 2 sets of—2 Feet Every Square (2), One foot Hop (2), and Hop Scotch (2)

Day 3: 2 sets of—2 Feet Every Square (2), Hop Scotch (2), and 2 in 2 out (2)

Day 4: 2 sets of—2 Feet Every Square (2), Single Leg Skier (2), and Ickey Shuffle (2)

Sets of each exercise can be repeated without the ExcelCord attached.

Brief descriptions of the above exercises are provided below:

2 feet every square: Using a speed and agility ladder laid out on the ground, step inside each square of the ladder with both feet.

Ickey Shuffle: Using a speed and agility ladder laid out on the ground, start on the side of the ladder. As the inside foot touches down in the square step in the square with the other foot. As the other foot lands, quickly step outside and up to the side of the next square with the inside foot. Place the outside foot inside the next square and repeat.

One foot hop: Using a speed and agility ladder laid out on the ground, hop in every square on one foot. After going up and back switch feet and repeat.

Hop Scotch: Using a speed and agility ladder laid out on the ground, hop in the first square with one foot then outside the square with both feet. Alternate feet every square. Start over if balance is lost or if a square is missed.

Skier: Using a speed and agility ladder laid out on the ground, keep both feet together and hop from the side of the ladder to inside the square to the other side of the ladder then up to the next square.

2 in 2 out: Using a speed ladder start with two feet outside the first square then jump with both feet landing inside the first square. Jump and straddle the next square before jumping inside the same square with both feet.

Single Leg Skier: Using a speed ladder, hop on one leg outside the first square then inside the square and out before moving up to the next square.

Example 5

Core Strength Training Regimen

A suggested four day training regimen is provided for use in improving the core strength of a user (FIG. 13).

On each day, the ExcelCord training device is strapped around the right foot, left foot, or both feet of the user. Prior to training on each day, warm-up and stretching is done as below:

Warm-up: high knees (20 repetitions), butt kicks (20), lunges (10), lunge flex (10)

Stretch: triceps, back, hamstrings, quadriceps, groin

Exercises performed with the ExcelCord device attached on day 1 through day 4 are performed as below.

Day 1: 2 sets of—Crunch (25), Bicycle (25), and Leg Raise (10)

Day 2: 2 sets of—V sit (15), Toe Touches (15), and Alternating Toe Touch (20)

Day 3: 2 sets of Leg Raise (15), Knee Tuck (20), and Seated Twist (30)

Day 4: 2 sets of—Knee Tuck and hold (30 sec), Leg Raise and hold (30 sec), Fire Hydrant (15 repetitions), and Kick Out (15 repetitions)

Sets of each exercise can be repeated without the ExcelCord attached.

Brief descriptions of the above exercises are provided below:

Crunch: Start by lying on back with knees bent and hands behind head. Bring elbows to knees keeping chin against chest.

Toe touch: Start by lying flat on back with arms and legs extended. Lift shoulders and back off the ground while reaching up to touch the opposite foot.

Alternating toe touch: Perform toe touch as above, alternating feet to complete one repetition.

Bicycle: Start with hands behind head with one knee pulled in towards chest. While extending the tucked knee bring other knee to chest and bring the opposite elbow to knee. Touch each knee to complete one repetition.

Knee Tuck: Lay flat on back with legs out in front. Bring knees to chest keeping feet together and off the ground. Be sure to keep shoulders on the ground while straightening knees.

Leg Raise: Lay on back with legs straight out in front. Keeping legs straight raise feet up until legs are perpendicular to the ground, V sit: Start in a sitting position, facing towards the handles with hands on the ground. Without letting feet touch the ground, lean back and straighten legs then lean forward and bring knees to chest.

Fire Hydrant: Start on all fours with resistance to the side. Keeping shoulders level and knees bent, raise outside knee until parallel to the ground to complete one repetition.

Kick out: Start on all fours with resistance to the side. Keeping shoulders level, raise knee parallel to the ground and kick out, away from the resistance.

Seated Twist: Sit at a 45 degree angle facing the resistance with feet barely off the ground. Alternate twisting shoulders left and right keeping feet still to complete one repetition.

Knee Tuck and Hold: Lay on back with legs straight and resistance in front of feet. Bring knees to chest and hold while keeping shoulders on the ground, Leg Raise and Hold: Lay on back with legs straight and resistance in front of feet. Keeping legs straight and feet together, raise legs so they make a 90 degree angle with ground and hold this position.

Example 6

Complete Baseball Training Regimen

A suggested four day training regimen for use in overall baseball training is provided by performing the training regimens detailed in Examples 1-5 as set forth above. For example, on Day 1 of the complete baseball training regimen, the user completes Day 1 of the Throwing, Lower body strength, Upper body strength, Speed, and Core training regimens.

While the invention has been disclosed with reference to specific embodiments, it is apparent that other embodiments and variations of the invention may be devised by others skilled in the art without departing from the true spirit and scope of the invention, The appended claims are intended to be construed to include all such embodiments and equivalent variations.

The disclosures of each and every patent, patent application, and publication cited herein are hereby incorporated herein by reference in their entirety.

What is claimed is:

1. A method of improving the throwing strength and motion of a user comprising the steps of:

providing a resistance assembly consisting of a harness that is wearable on the exterior of a foot or footwear of a user, at least one elastic resistance cord having a first end attachable to the harness, and a handle attached to a second end of the at least one resistance cord;

attaching the harness to the foot or footwear of the user;

releasably attaching the first end of the at least one elastic resistance cord to the harness, such that the connection of the at least one elastic resistance cord to the harness is positioned at a heel of the user;

anchoring the second end of the at least one elastic resistance cord at a distance from the user such that extension of the at least one elastic resistance cord provides resistance; and performing at least one throwing exercise using an upper limb of the user through the resistance of the at least one elastic resistance cord, such that the upper limb moves through a resistance-less motion during the at least one throwing exercise.

2. The method of claim 1, further comprising the steps of:

providing a second resistance assembly consisting of a second harness that is wearable on the exterior of a second foot or footwear of the user, at least one additional elastic resistance cord having a first end attachable to the second harness, and a second handle attached to a second end of the at least one additional elastic resistance cord;

attaching the second harness to the second foot or footwear of the user;

releasably attaching the first end of the at least one additional elastic resistance cord to the second harness, such that the connection of the at least one additional elastic resistance cord to the second harness is positioned at a second heel of the user; and anchoring the second end of the at least one additional elastic resistance cord at a distance from the user such that extension of the at least one additional elastic resistance cord provides resistance.

3. The method of claim 1, further comprising the steps of:

removing the at least one elastic resistance cord from the harness; and performing the at least one throwing exercise without the resistance of the at least one elastic resistance cord.

4. The method or claim 1, wherein anchoring the second end of the at least one elastic resistance cord comprises the holding of the second end by a second user.

5. The method of claim 4, wherein the second user moves during the at least one throwing exercise thereby moving a point of resistance during the exercise.

* * * * *